US010670355B2

(12) United States Patent
Kincel et al.

(10) Patent No.: US 10,670,355 B2
(45) Date of Patent: Jun. 2, 2020

(54) GAS ACCUMULATION CHAMBER

(71) Applicant: BRAVO COMPANY MFG, INC., Hartland, WI (US)

(72) Inventors: Eric Stephen Kincel, Coeur d'Alene, ID (US); Jeffrey James O'Brien, Coeur d'Alene, ID (US)

(73) Assignee: Bravo Company MFG, Inc., Hartland, WI (US)

( * ) Notice: Subject to any disclaimer, the term of this patent is extended or adjusted under 35 U.S.C. 154(b) by 0 days.

(21) Appl. No.: 16/238,929

(22) Filed: Jan. 3, 2019

(65) Prior Publication Data

US 2020/0003508 A1 Jan. 2, 2020

Related U.S. Application Data

(63) Continuation-in-part of application No. 16/025,696, filed on Jul. 2, 2018.

(51) Int. Cl.

| | |
|---|---|
| ***F41A 5/18*** | (2006.01) |
| ***F41A 3/26*** | (2006.01) |
| ***F41A 3/66*** | (2006.01) |
| *F41A 3/72* | (2006.01) |
| *F41A 15/14* | (2006.01) |

(52) U.S. Cl.

CPC *F41A 5/18* (2013.01); *F41A 3/26* (2013.01); *F41A 3/66* (2013.01); *F41A 3/72* (2013.01); *F41A 15/14* (2013.01)

(58) Field of Classification Search

CPC .... F41A 3/66; F41A 3/72; F41A 13/00; F41A 5/18; F41A 3/26; F41A 15/14

USPC ..... 42/16, 75.02, 75.03

See application file for complete search history.

(56) References Cited

U.S. PATENT DOCUMENTS

| | | | | |
|---|---|---|---|---|
| 2,951,424 | A | 9/1960 | Stoner | |
| 6,311,603 | B1 | 11/2001 | Dunlap | |
| 7,798,045 | B1 | 9/2010 | Fitzpatrick et al. | |
| 7,886,470 | B1 * | 2/2011 | Doiron | F41A 3/46 42/16 |
| 8,316,756 | B1 | 11/2012 | Woodell et al. | |
| 8,590,199 | B2 | 11/2013 | Overstreet et al. | |
| 8,826,797 | B2 | 12/2014 | Overstreet et al. | |
| 8,910,406 | B1 * | 12/2014 | Huang | F41A 3/66 42/16 |
| D759,780 | S | 6/2016 | Wang | |
| 9,470,472 | B2 * | 10/2016 | Kincel | F41G 11/003 |
| 9,551,545 | B1 | 1/2017 | Rowe | |
| D787,005 | S * | 5/2017 | Capps | D22/108 |
| 9,677,833 | B2 | 6/2017 | Kincel | |
| D815,237 | S * | 4/2018 | Podgurny | D22/108 |
| 10,132,580 | B1 * | 11/2018 | Kincel | F41A 7/02 |

(Continued)

*Primary Examiner* — Joshua E Freeman

(74) *Attorney, Agent, or Firm* — Michael Best & Friedrich LLP

(57) ABSTRACT

An upper receiver for a firearm. The firearm includes a barrel extending forward of the upper receiver and a buttstock extending rearward of the upper receiver. The upper receiver includes forward gas escape ports through a frame of an ejection port through which spent casings are ejected. The upper receiver further includes a trough formed on an inside surface of the frame. The trough collects gases in the chamber and distributes the gases to the gas escape ports. The gas escape ports are covered by an ejection port door when a shell is not being ejected.

3 Claims, 16 Drawing Sheets

(56) References Cited

U.S. PATENT DOCUMENTS

| | | | | |
|---|---|---|---|---|
| 2010/0212201 | A1* | 8/2010 | Kincel | F41G 11/003 42/2 |
| 2011/0252957 | A1 | 10/2011 | Overstreet et al. | |
| 2012/0174451 | A1 | 7/2012 | Overstreet et al. | |
| 2013/0092014 | A1 | 4/2013 | Kincel | |
| 2014/0150639 | A1* | 6/2014 | Sugg | F41A 3/68 89/193 |
| 2016/0258699 | A1* | 9/2016 | Sigler | F41A 3/66 |
| 2016/0258713 | A1* | 9/2016 | Huang | F41A 3/66 |
| 2016/0320151 | A1* | 11/2016 | Kincel | F41A 3/72 |
| 2017/0191770 | A1 | 7/2017 | Stewart et al. | |
| 2017/0261276 | A1* | 9/2017 | Morris | F41A 15/16 |
| 2017/0336158 | A1 | 11/2017 | Kincel | |
| 2018/0080726 | A1* | 3/2018 | Smith | F41A 35/06 |
| 2018/0356171 | A1* | 12/2018 | Brown | F41A 15/14 |

* cited by examiner

GAS ACCUMULATION CHAMBER

BACKGROUND

A traditional upper receiver 10 for meeting military specifications (MIL SPEC) for the AR-15 firearm is illustrated in FIGS. 1-3. Referring to FIG. 1, the upper receiver 10 includes a rear end 10*a* and a front end 10*b*. The rear end 10*a* of the upper receiver 10 includes a charging handle slot 12 defined between a top wall 14 and a sidewall 16 of the upper receiver 10. The top wall 14 includes a flat (i.e., planar), downwardly-facing surface 18 and the sidewall 16 of the upper receiver 10 defines a generally curved, rear-facing end wall 20 on each side of the slot 12. The generally curved end walls 20 have a relatively vertical center portion and angled top and bottom portions. The shape of the slot 12 follows relatively closely the shape of a charging handle for the firearm such that the forward-facing surface of the charging handle fits against the rear-facing end wall 20. A chamber 22 inside the upper receiver 10 is traditionally formed with a milling operation from the front end 10*b* of the upper receiver 10 and the slot 12 is traditionally formed with a broaching operation from the rear end 10*a* because the area of the slot 12 is not accessible with a traditional mill from the front end 10*b*.

With reference to FIGS. 2 and 3, the front end 10*b* of the upper receiver 10 includes a gas tube placement hole or gas tube port 30 through which the gas tube 32 enters the upper receiver 10. The gas tube port 30 is surrounded by four symmetrical lobes 34 which communicate with the gas tube port 30. The lobes 34 accommodate misalignment of the gas tube 32 with respect to the central axis of the gas tube port 30. The upper receiver 10 includes a gas accumulation space 36 immediately rearward of the gas tube port 30, where gases expand as they enter the upper receiver 10. The gas accumulation space 36 communicates with the chamber 22.

SUMMARY

In one aspect, the invention provides an upper receiver for a firearm having a barrel extending forward of the upper receiver and a buttstock extending rearward of the upper receiver, the upper receiver comprising: a chamber communicating with the barrel to receive high pressure barrel gases for actuating an action of the firearm; an ejection port through which a spent round is ejected as part of the action of the firearm, the ejection port defined at least in part by a frame; a trough formed into a surface of the upper receiver and communicating with the chamber; and a gas escape port extending through the frame and communicating with the trough such that barrel gases in the chamber are collected in the trough and vented through the gas escape port. The upper receiver may further comprise an ejection port door biased to cover the ejection port and opening under the influence of pressure from the barrel gases to open to permit ejection of the spent round. The gas escape port may include a plurality of gas escape ports extending through the frame and communicating with the trough.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1:
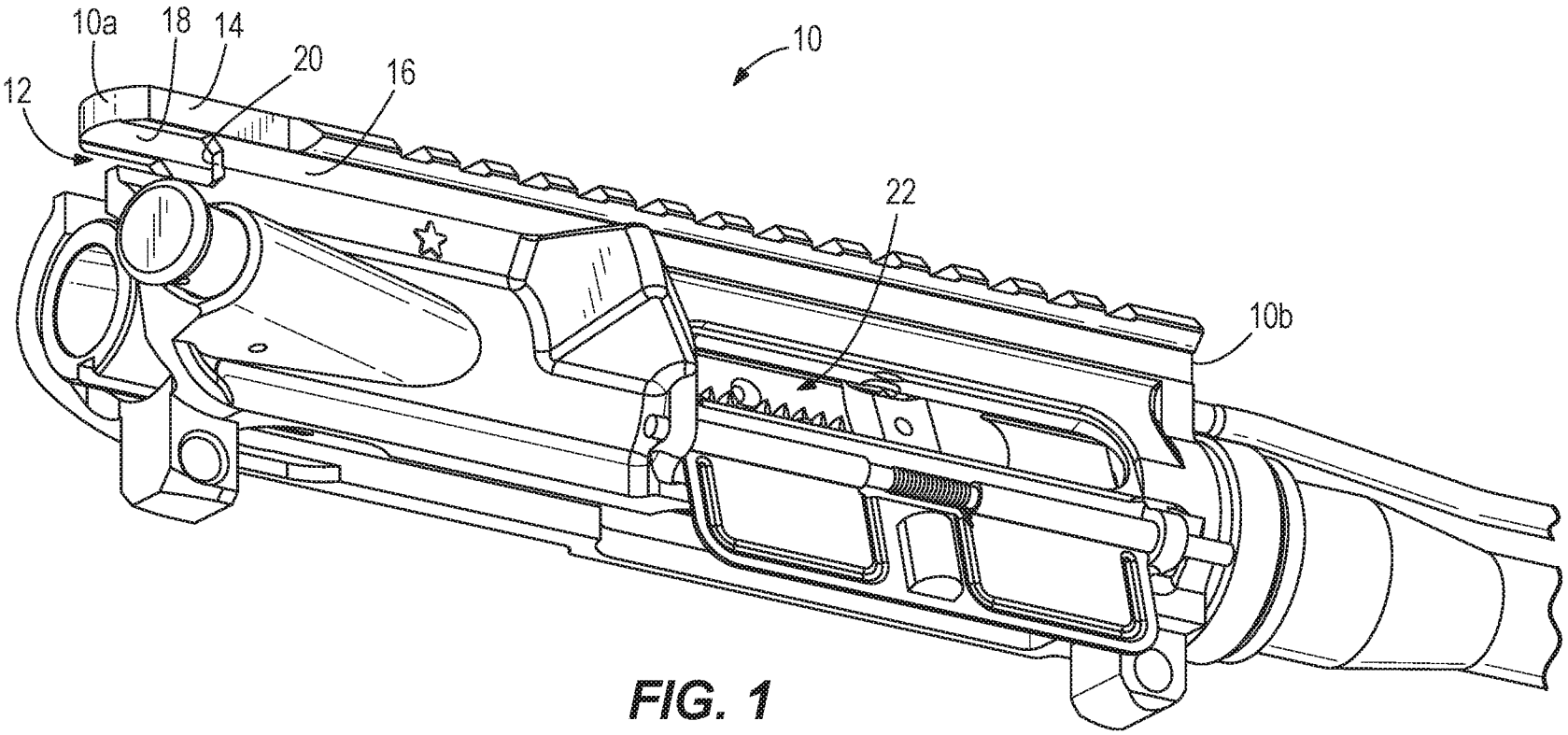
FIG. 1 PRIOR ART
FIG. 1 is a rear perspective view of a prior art upper receiver.
Figure 2:
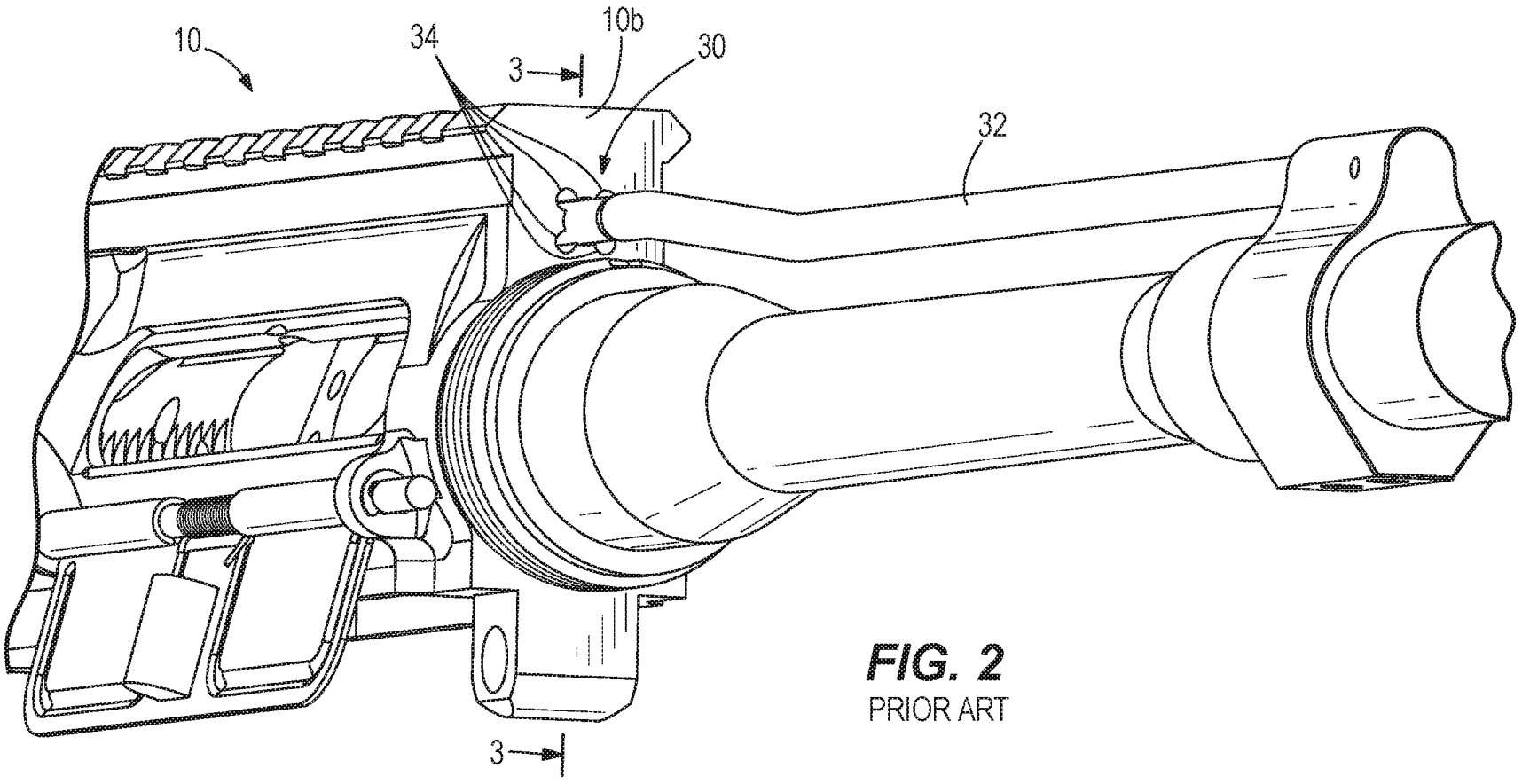
FIG. 2 PRIOR ART
FIG. 2 is a front perspective view of the prior art upper receiver.
Figure 3:
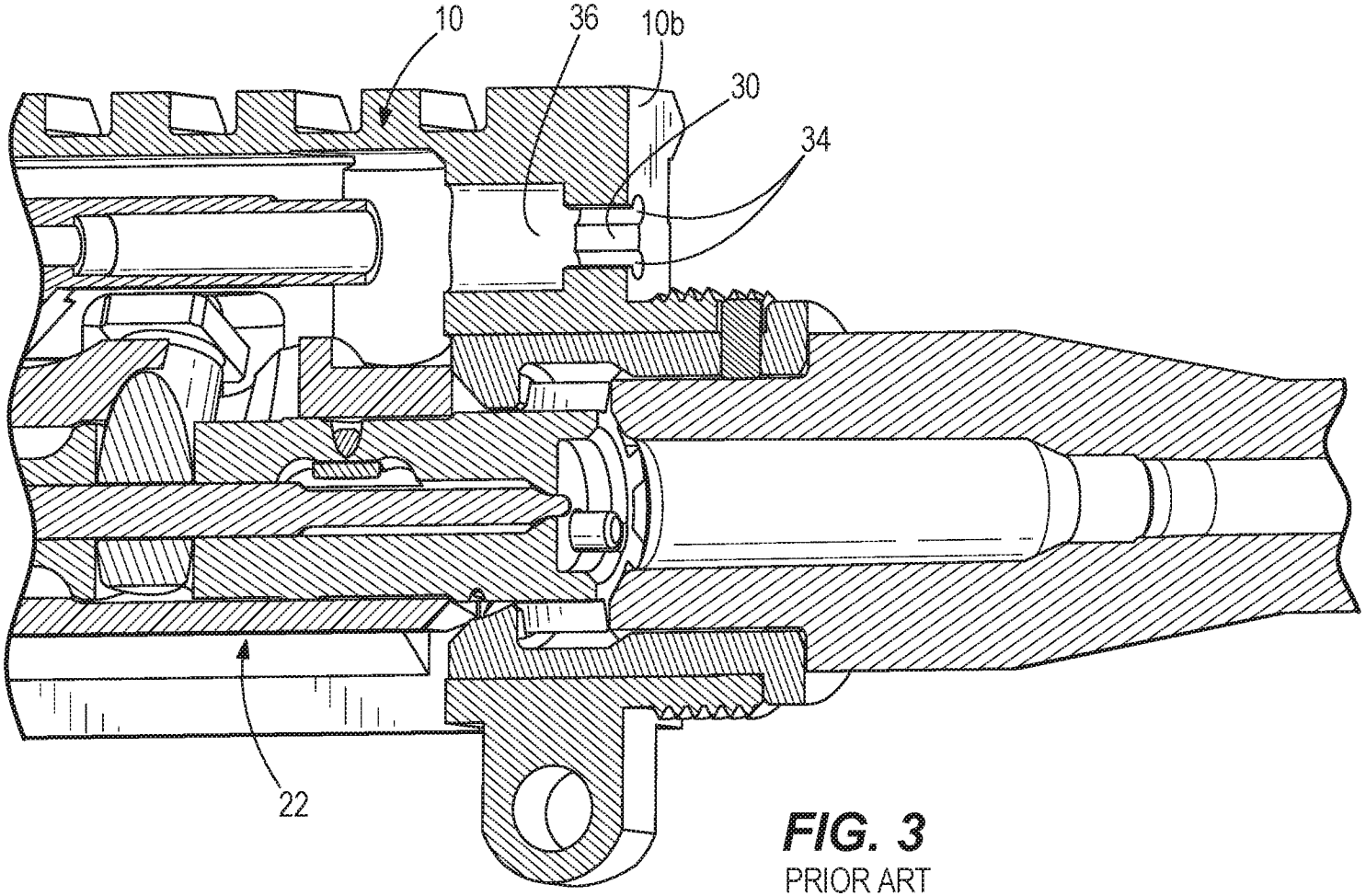
FIG. 3 PRIOR ART
FIG. 3 is a cross-sectional view taken along line 3-3 in FIG. 2 of the prior art upper receiver.

With continued reference to FIGS. 1-3, the inventors have recognized that, in a traditional AR-15, the pressurized barrel gases in the chamber 22 will bleed out of any opening in the upper receiver 10 that communicates with the chamber 22. Much of the gas is vented out the rear end 10*a* of the upper receiver 10 through the slot 12. The pressure of gases in the upper receiver 10 is amplified when a sound suppressor is used on the muzzle of the firearm. Suppressors produce additional back pressure and can more than double the volume of gas escaping the upper receiver 10. The inventors recognize that the barrel gases in the chamber 22 vent around the charging handle at the rear end 10*a* of the upper receiver 10 and through the lobes 34 around the gas tube 32 at the front end 10*b*. The inventors have also recognized that the flat downwardly-facing surface 18 of the slot 12 results in gases being discharged from the upper receiver 10 over the top of the charging handle rearward. Gases moving rearward move in a direction toward the operator's face during ordinary operation of the firearm. The inventors have recognized that gases discharged rearward from the upper receiver 10 can be distracting to the operator.

The inventors propose an improvement on the traditional AR-15 for directing gases out of the upper receiver 10 in directions other than rearward. As will be described below, the present invention includes other advantageous aspects including a potentially more rapid discharge of gases from the upper receiver 10 and the potential for reducing the weight of the upper receiver 10. It should be recognized by one of ordinary skill in the art that, although the invention is described with respect to an AR-15 application, the invention can be applied with equal success to many other types of firearms in which barrel gases flow rearward in a manner that can distract the operator. Unless specifically stated as being limited to the AR-15 application, the invention is not limited to the embodiment described and illustrated here.

Figure 4:
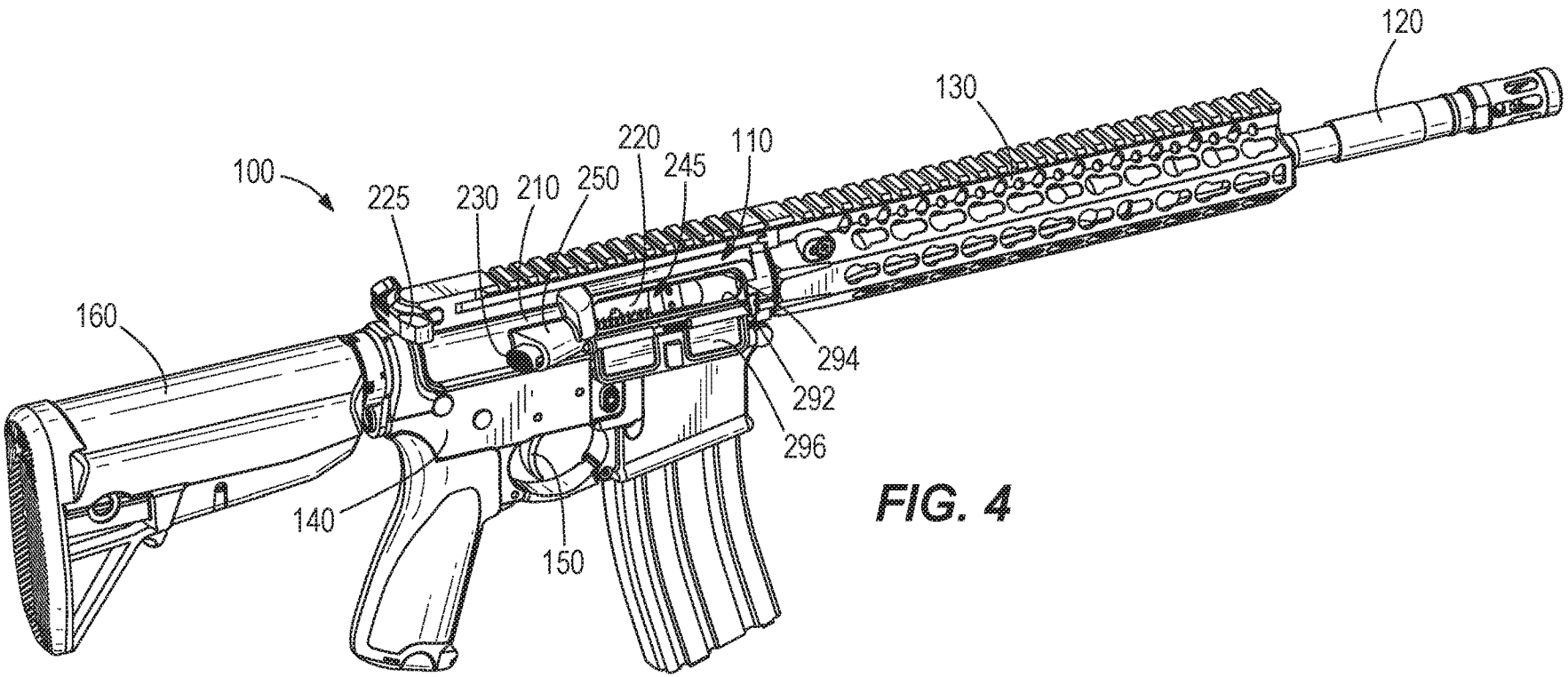
FIG. 4 illustrates an exemplary firearm including an embodiment of the present invention.

FIG. 4 illustrates an exemplary firearm 100 which may embody the present invention. The illustrated firearm 100 is an AR-15 rifle and includes an upper receiver assembly 110 to which a barrel 120, hand guard 130, lower receiver 140 including a trigger assembly 150, buttstock 160, gas block 170 (FIG. 8), and gas tube 180 (FIG. 8) are mounted. The barrel 120 is at the front of the firearm 100 and the buttstock 160 is at the back of the firearm 100. For the purposes of this disclosure, the term "forward" and its variations (e.g., "forwardly") mean in a direction from the upper receiver generally along the barrel 120 and the term "rearward" and its variations (e.g., "rearwardly") mean in a direction from the upper receiver generally along the buttstock 160. When the firearm 100 is used in its ordinary, intended manner, the rearward direction is toward the operator's face, which is positioned adjacent the side and top of the buttstock 160.

Figure 5:
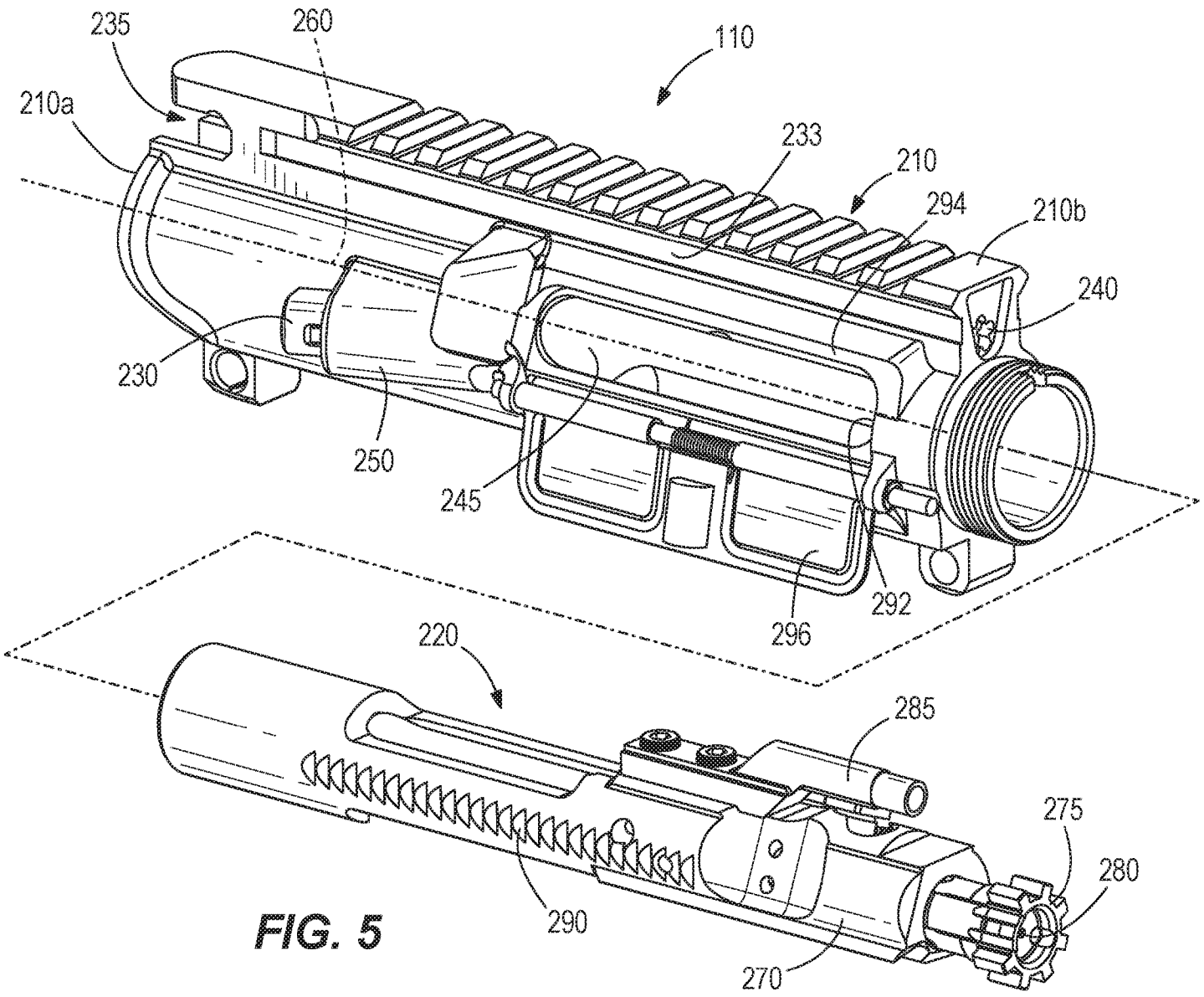
FIG. 5 is an exploded view of an upper receiver assembly of the firearm.

Referring to FIG. 5, the upper receiver assembly 110 includes an upper receiver 210 that supports a bolt carrier group 220, a charging handle 225 (FIG. 4), and a forward assist assembly 230, among other components. The upper receiver 210 includes a rear end 210*a* and a front end 210*b*. A charging handle channel 233 extends from the rear end 210*a* to the front end 210*b* and accommodates the length of the charging handle 225. The rear end 210*a* includes a charging handle slot 235 in the charging handle channel 233. The front end 210*b* includes a gas tube port 240.

The upper receiver 210 defines a chamber 245 into which the bolt carrier group 220 is installed and a forward assist bore 250 into which the forward assist assembly 230 is installed. The chamber 245 defines a main axis 260 (i.e., a longitudinal axis of the chamber 245) that is collinear with the axis of the barrel 120. The bolt carrier group 220 reciprocates along the main axis 260 in the chamber 245. The longitudinal axis or extent of the overall firearm 100 is parallel to or collinear with the main axis 260.

The bolt carrier group 220 includes a bolt carrier 270, a bolt 275, a firing pin 280, a gas key 285, and other components. Ratchet teeth 290 are formed in the side of the bolt carrier 270 that faces the forward assist assembly 230. In operation, the front end of the bolt 275 carries a round to be fired. The bolt carrier group 220 slides fully forward and the bolt 275 is locked in place before firing. The gas key 285 receives a free end of the gas tube 180 when the bolt carrier group 220 is in the fully forward position. With the bolt 275 locked in place, the firing pin 280 is actuated by the trigger assembly 150 to fire the bullet of the properly-chambered round. The bullet travels down the barrel 120 under the influence of an explosion of gas generated by the round. During ordinary operation of the firearm 100, high-pressure gases are returned from the barrel 120 to the chamber 245 via the gas block 170, gas tube 180, and gas key 285. The barrel gases are under very high pressure, which provides a motive force for sliding the bolt carrier group 220 rearward and ejecting the spent round casing. The spent round casing is ejected out of the right side of the firearm 100 through an ejection port 292. The ejection port 292 is surrounded by a frame or shroud 294 and is covered by an ejection port door 296 which is hingedly coupled at its bottom to the upper receiver 210. The ejection port door 296 is spring biased to fit within the shroud 294 and cover the ejection port 292, but is flung open by high-pressure gases in the chamber 245 when the spent round casing is ejected.

A new round is automatically fed into the chamber 245 and the bolt carrier group 220 again moves forward under the influence of a spring. Once moved fully forward, the bolt 275 locks and the firearm is ready to fire again. In the event the bolt carrier group 220 fails to move fully forward, the forward assist assembly 230 can be manually actuated to incrementally urge the bolt carrier group 220 forward through engagement with the ratchet teeth 290. The charging handle 225 has a hook end that fits around the gas key 285 and is used to draw the bolt carrier group 220 back for loading an initial round, clearing a jammed round, or under any other circumstance in which the bolt carrier group 220 must be manually moved rearwardly.

Figure 6:
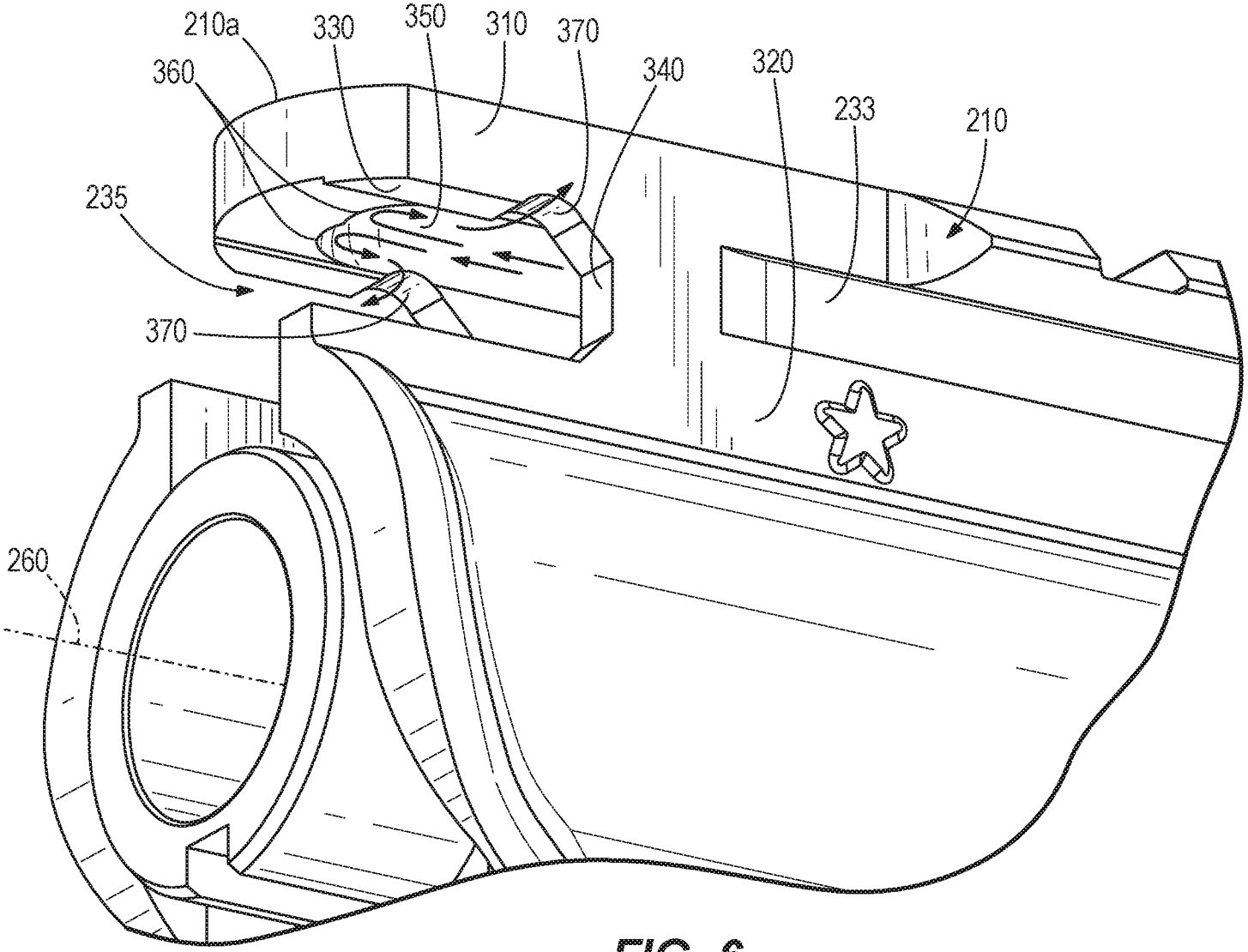
FIG. 6 is a rear perspective view of the upper receiver.
Figure 7:
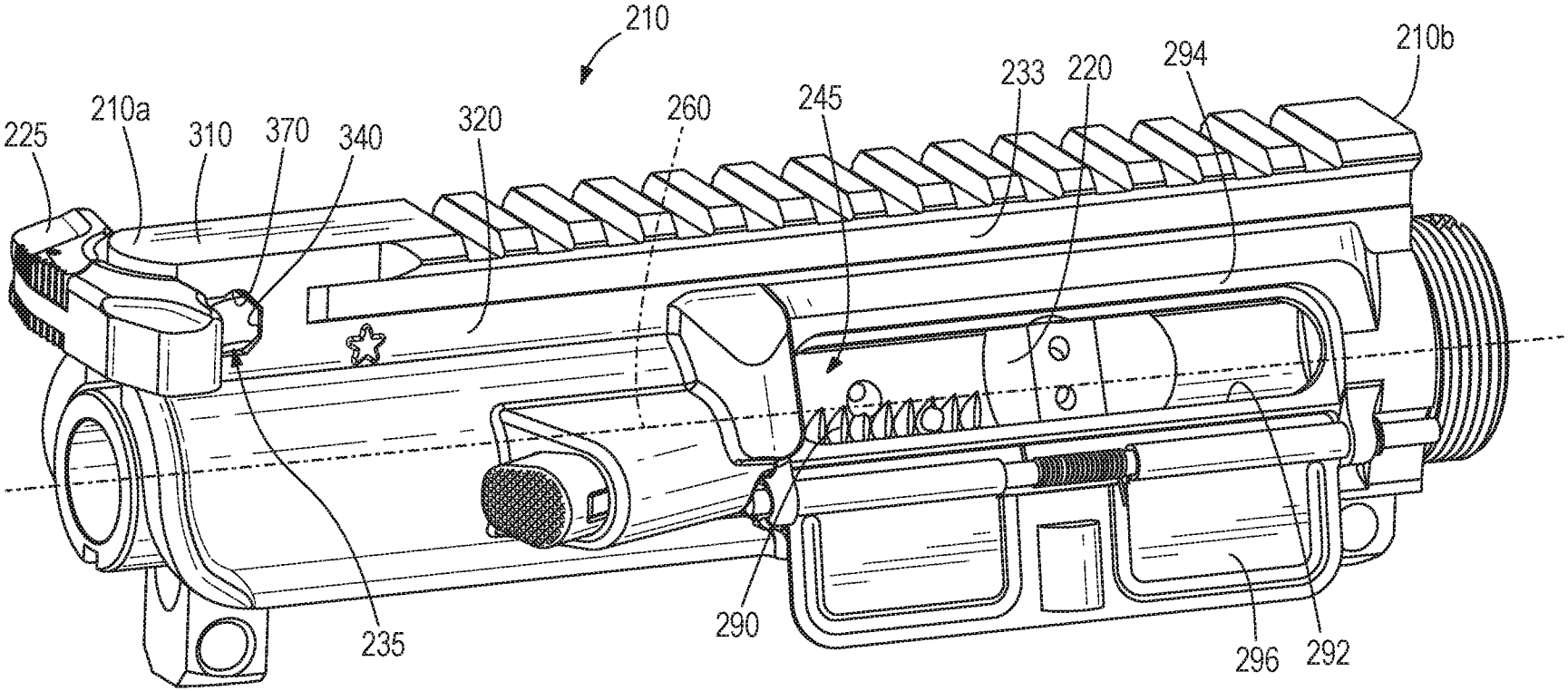
FIG. 7 is another rear perspective view of the upper receiver with the charging handle installed.

Turning now to FIGS. 6 and 7, the charging handle slot 235 is formed between a top wall 310 and a side wall 320 of the upper receiver 210. The top wall 310 includes a downwardly-facing surface 330 and each sidewall 320 defines a generally curved rear-facing end wall 340 of the slot 235. In the illustrated embodiment, the downwardly-facing surface 330 has formed into it a recess 350 that defines a pair of arcuate surfaces 360. With the recess 350, the overall volume over the charging handle at the rear of the upper receiver 210 is 0.025 cubic inches, which is five times the 0.005 cubic inches of volume over the charging handle in the prior art configuration with the flat downwardly-facing surface 18 (FIG. 1). This increased volume over the charging handle is sufficient to reduce pressure of gas flowing over the top of the charging handle so that the gases can be diverted as discuss below.

The illustrated slot 235 includes a side port or rear escape port 370 on each side of the slot 235 at the junction of the top wall 310 and each curved end wall 340. The rear escape ports 370 communicate with the recess 350 through the sidewall 320 of the upper receiver 210. The recess 350 and arcuate surfaces 360 may be formed, for example, with an end milling process from the rear end 210*a* of the upper receiver 210. The rear escape ports 370 may be formed, for example, by end milling from the rear end 210*a* of the upper receiver 210 or by drilling through the sidewalls 320. The rear escape ports 370 are formed into the slot 235 in FIGS. 6 and 7 or stated another way the rear escape ports 370 intersect the slot 235.

The gas flow path is illustrated in FIG. 6. The arcuate surfaces 360 turn rearwardly-directed gas moving over the top of the charging handle 225 to the sides. In some embodiments, the charging handle 225 may have formed in its top surface similarly-shaped arcuate surfaces that register with the arcuate surfaces 360 and assist the gas-turning function. The arcuate surfaces 360 are symmetrical to each other in the illustrated embodiment and meet at a central point vertically above (i.e., in a vertical plane that includes) the main axis 260. As such, the arcuate surfaces 360 of the illustrated embodiment roughly evenly divide the rearwardly-directed gas and steer it to the left and right sides in roughly equal volumes where the gas can be vented through the rear escape ports 370.

The gas leaving the rear escape ports 370 flows in a non-rearward direction such that there is no distracting gas flow into the operator's face. In the illustrated embodiment, the gas flowing out of the rear escape ports 370 flows horizontal and perpendicular to the main axis 260, but in other embodiments the rear escape ports 370 may be configured to vent the gas at an angle forwardly or rearwardly at substantially any desired angle between perpendicular and parallel to the main axis 260 provided it is not directed into the operator's face. The rear escape ports 370 may also be configured to vent the gas upwardly or downwardly at a desired angle instead of horizontally.

Figure 8:
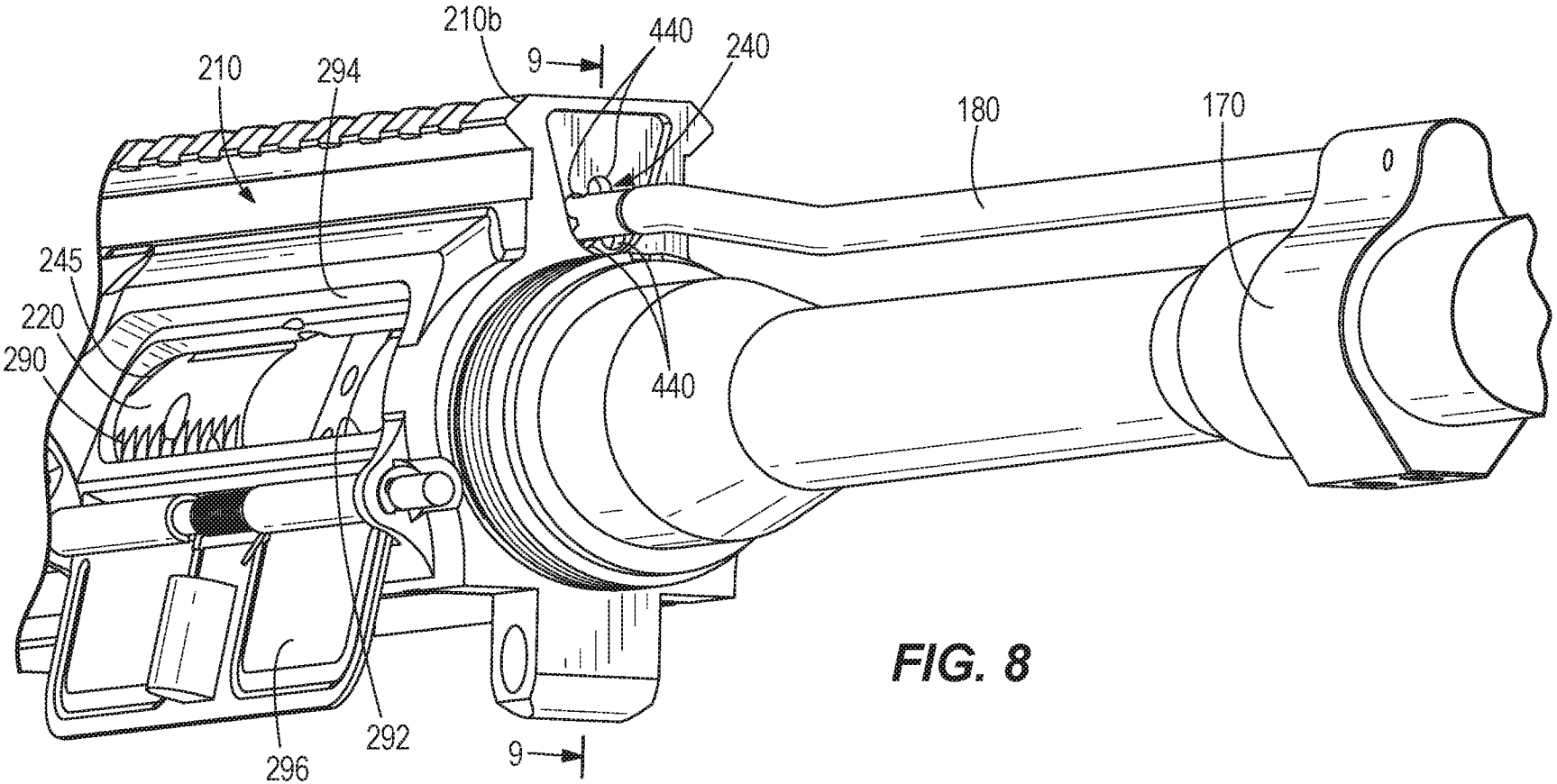
FIG. 8 is a front perspective view of the upper receiver, barrel, and gas tube.
Figure 9:
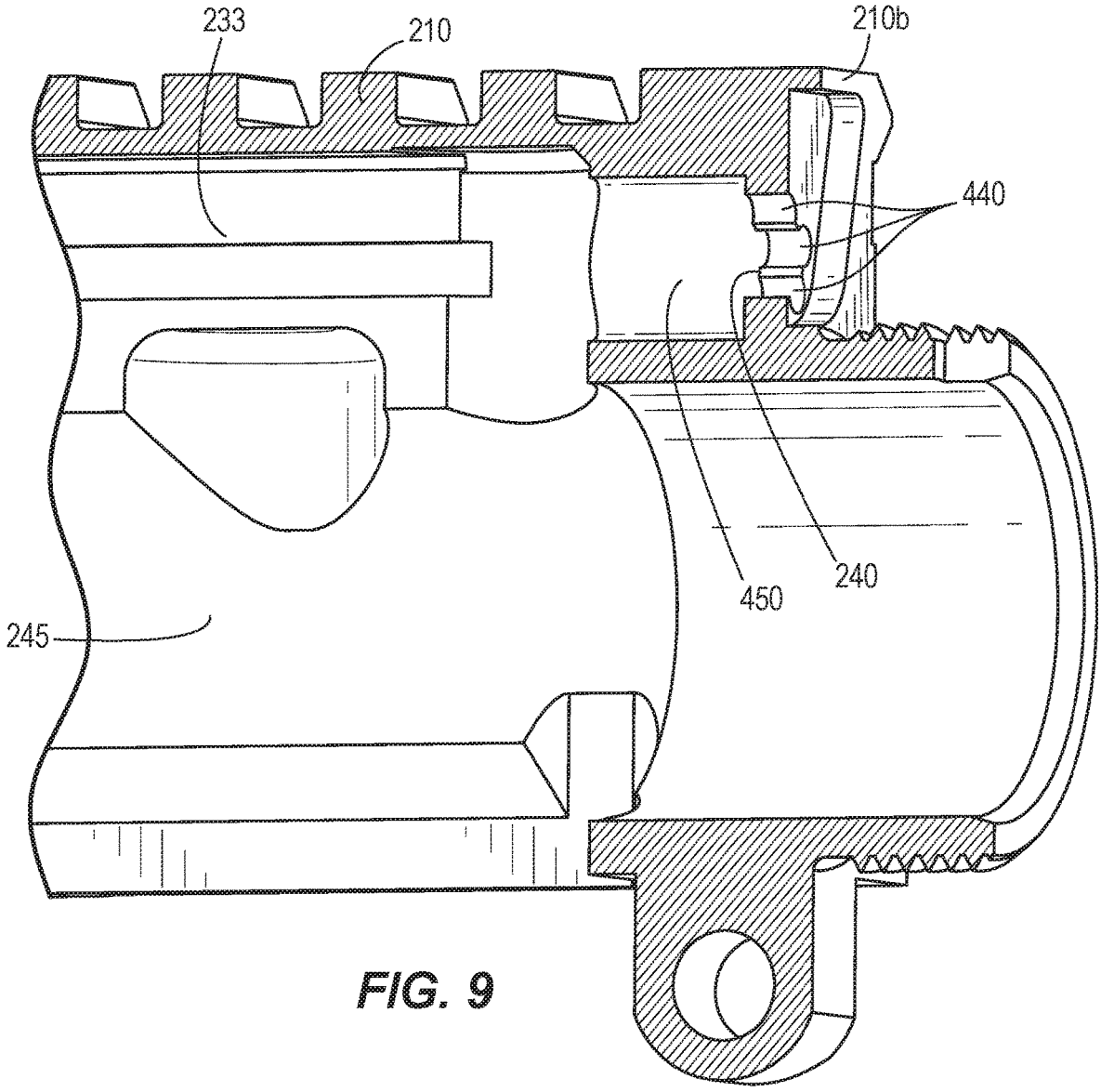
FIG. 9 is a cross-sectional view of the front end of the upper receiver along line 9-9 in FIG. 8.

With reference now to FIGS. 8 and 9, and as noted above, the front end 210*b* of the upper receiver 210 includes a gas tube port 240 through which the gas tube 180 enters the upper receiver 210 and terminates at a free end. The gas tube port 240 is surrounded by five symmetrical lobes 440 which communicate with the gas tube port 240. The lobes 440 accommodate misalignment of the gas tube 180 with respect to the central axis of the gas tube port 240. The upper receiver 210 further includes a gas accumulation space 450 (FIG. 9) immediately rearward of the gas tube port 240, where gases expand as they enter the upper receiver 210.

Each of the five lobes 440 is of the same size as the prior art lobes 34 (see FIGS. 2 and 3). The five lobes 440 of the present upper receiver 210 provide 25% more venting surface area than the four lobes 34 in the prior art. The invention is not limited to exactly five lobes 440 and the lobes 440 could have different shapes and sizes. For example, in other embodiments the number of lobes 440 could be three, four, five, six, or more, provided that the lobes 440 serve the essential function of accommodating off-axis alignment of the gas tube 180 while providing a higher overall venting surface area than the traditional lobes 34.

The gas accumulation space 450 is enlarged (in terms of diameter and depth) compared to the gas accumulation space 36 illustrated in FIG. 3. More specifically, the prior art gas accumulation space 36 has a volume of 0.029 cubic inches and the enlarged gas accumulation space 450 has a volume of 0.046 cubic inches. The gas accumulation space 450 communicates with and between the charging handle channel 233, the chamber 245, the gas tube port 240, and the lobes 440. An enlarged gas accumulation space 450 increases the volume into which the barrel gases are introduced, which has the inherent effect of lowering the pressure of the barrel gases. From the gas accumulation space 450 the gases can follow the path of least resistance out of the upper receiver, through the charging handle channel 233 to the recess 350 (and out through the side ports 370) in the rear 210*a* or through the lobes 440 at the front 210*b*. Additionally, the increased volume of the gas accumulation space 450 is associated with removal of more surrounding material from the upper receiver 210. This is also true to a lesser extent with respect to the enlarged venting surface area provided by the lobes 440. The removal of more material from the upper receiver 210 makes the upper receiver 210 lighter.

Figure 10:
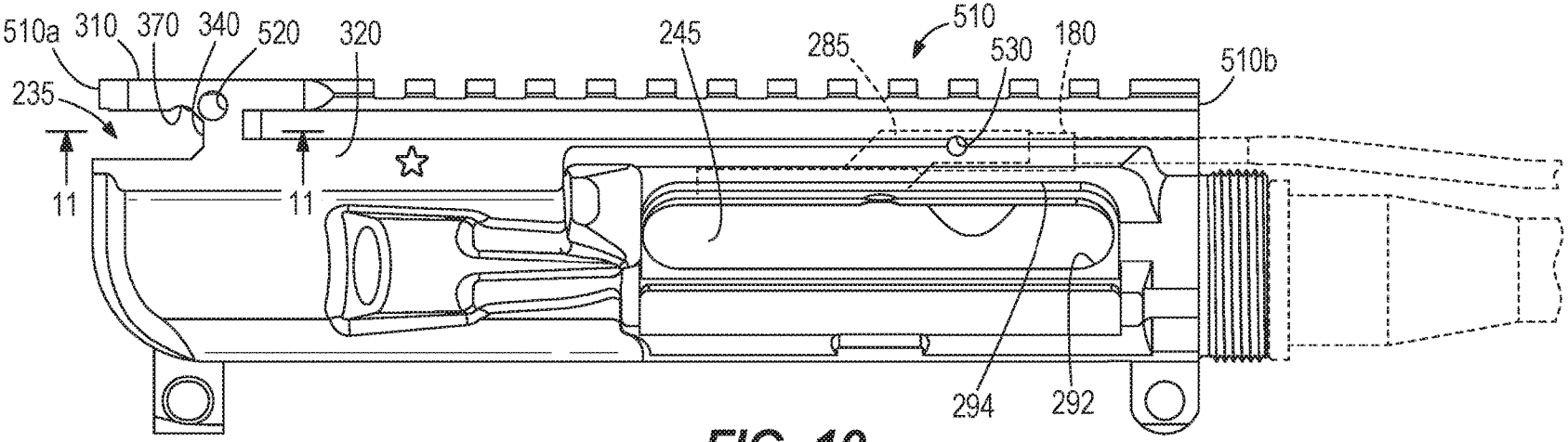
FIG. 10 is a side view of the upper receiver with additional and alternative gas escape ports.
Figure 11:
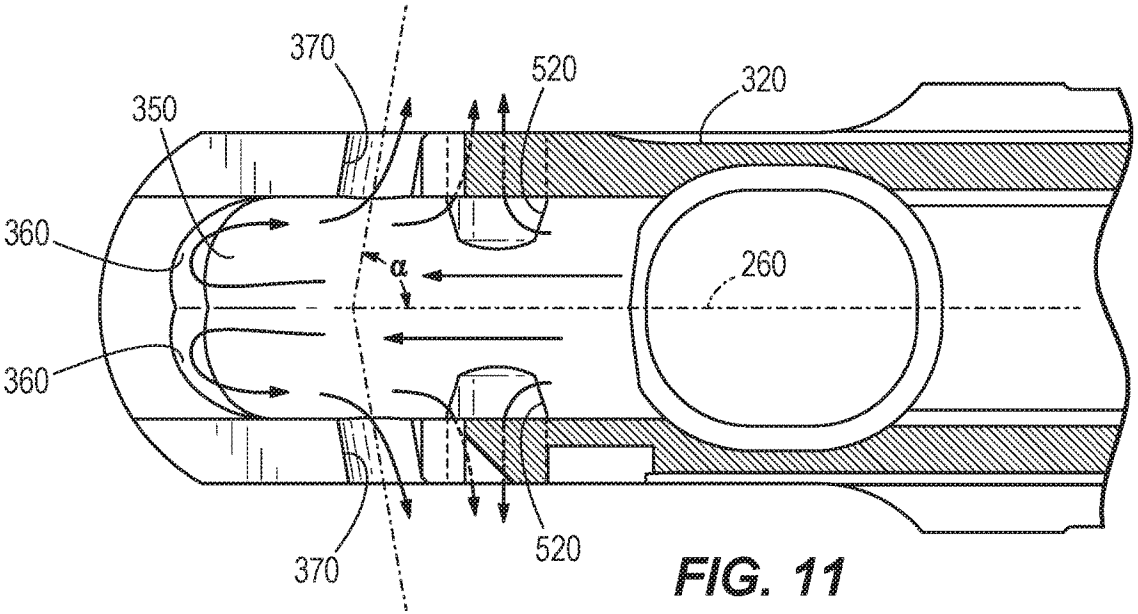
FIG. 11 is a cross-sectional view along line 11-11 in FIG. 10.

FIGS. 10 and 11 illustrate an alternative construction of an upper receiver 510 which includes substantially all of the same features as the above-described upper receiver 210, such features being labeled with the same reference numbers as used above. The upper receiver 510 includes a rear end 510*a* and a front end 510*b*. The upper receiver 510 includes an additional rear escape port 520 forward of the associated rear escape port 370 and is drilled or otherwise formed through the side 320 of the upper receiver 510 above the ejection port 292.

As illustrated in FIG. 11, the additional rear escape ports 520 communicate with the recess 350 and are independent of (i.e., do not intersect) the slot 235. The rear escape ports 370 are angled forwardly with respect to the main axis 260 at an angle $\alpha$ of about 65-85° while the additional rear escape ports 520 are horizontal and perpendicular to the main axis 260. The upper receiver 510 also includes a forward escape port 530 drilled through each side 320 of the upper 510. The forward escape ports 530 communicate with the chamber 245 proximate the end of the gas tube 180.

Figure 12:
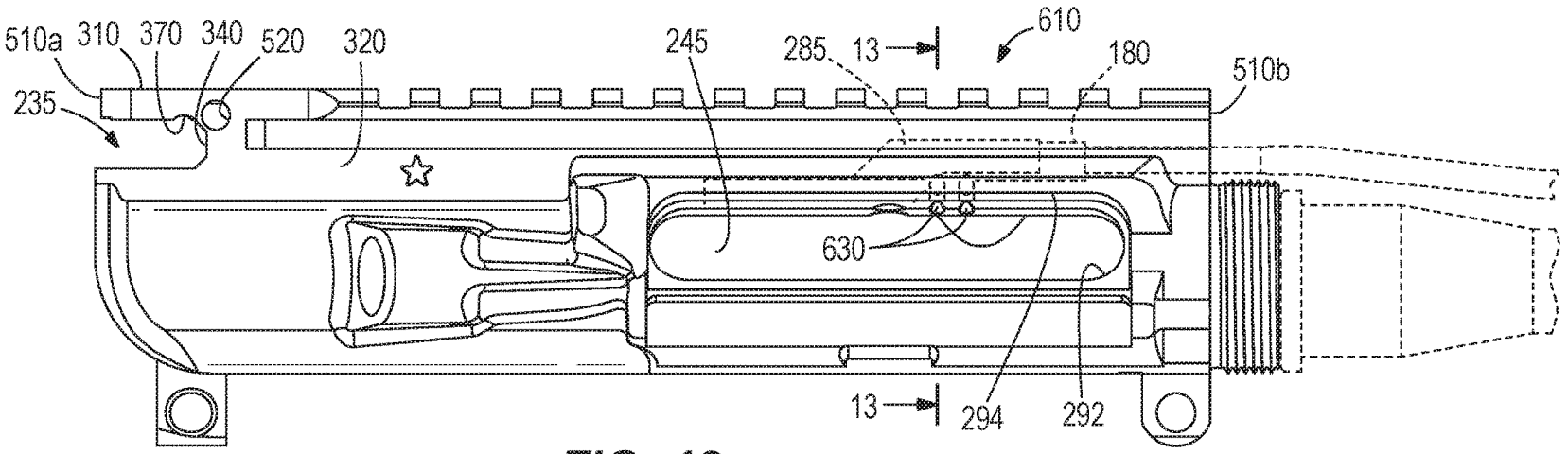
FIG. 12 is a side view of the upper receiver with additional and alternative gas escape ports.
Figure 13:
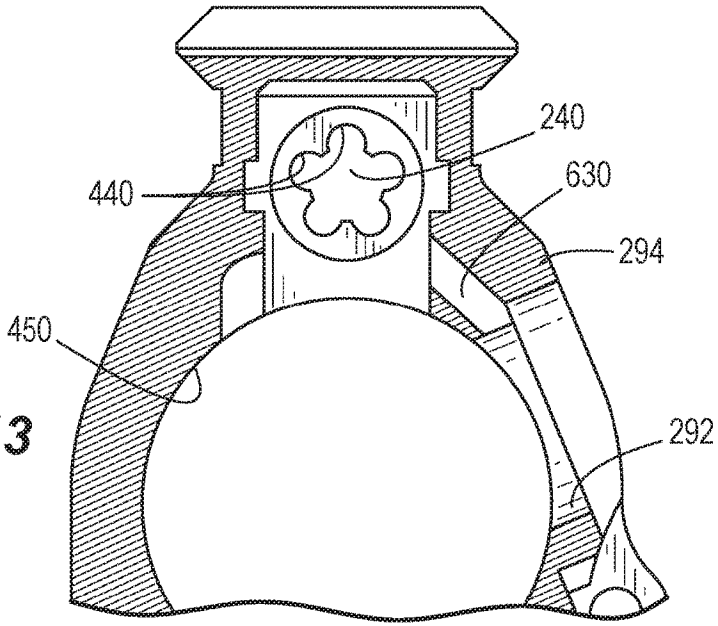
FIG. 13 is a cross-sectional view along line 13-13 in FIG. 12.
Figure 14:
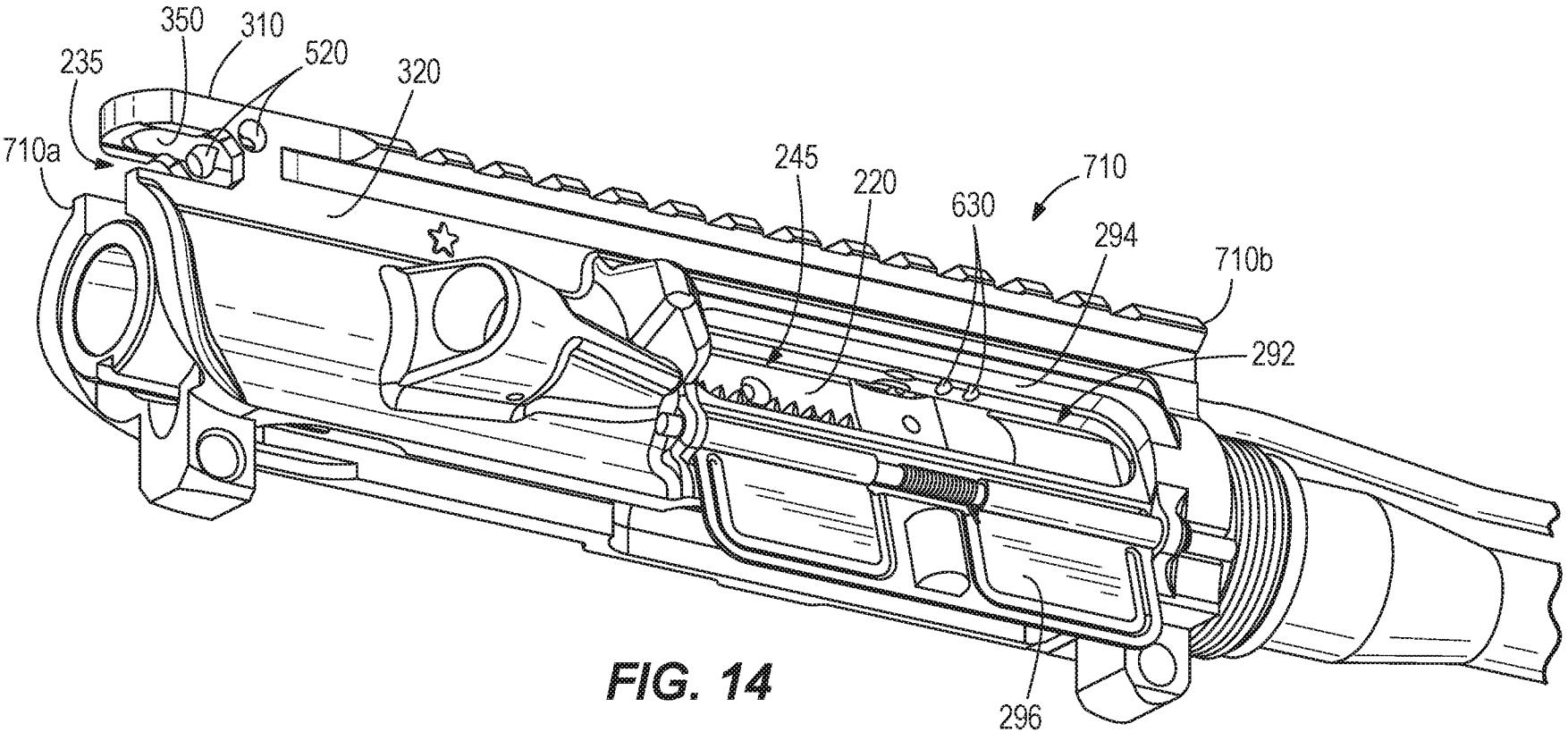
FIG. 14 is a rear lower perspective view of the upper receiver with a trough feature for the forward escape ports.
Figure 15:
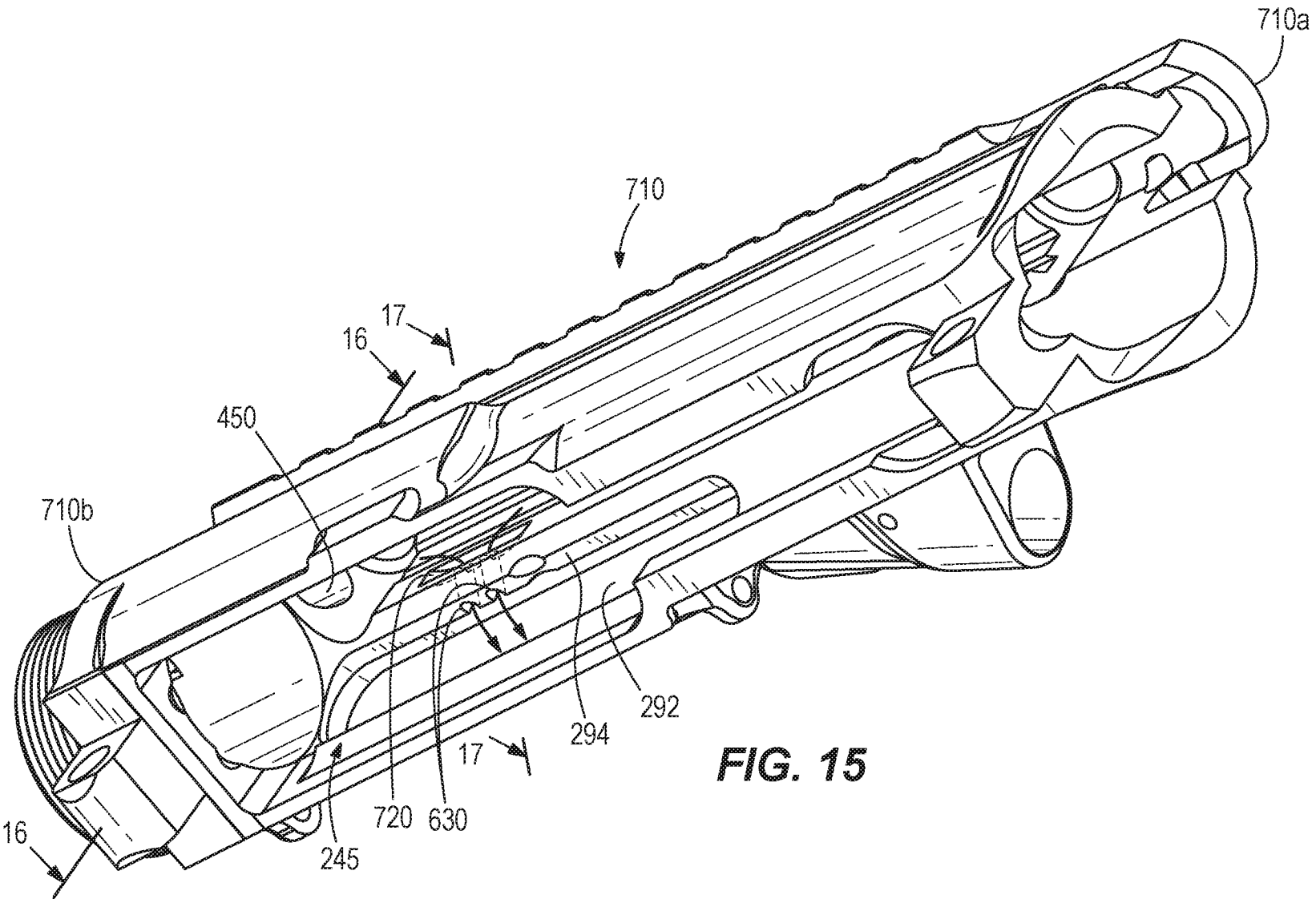
FIG. 15 is a lower perspective view of the upper receiver of FIG. 14.
Figure 16:
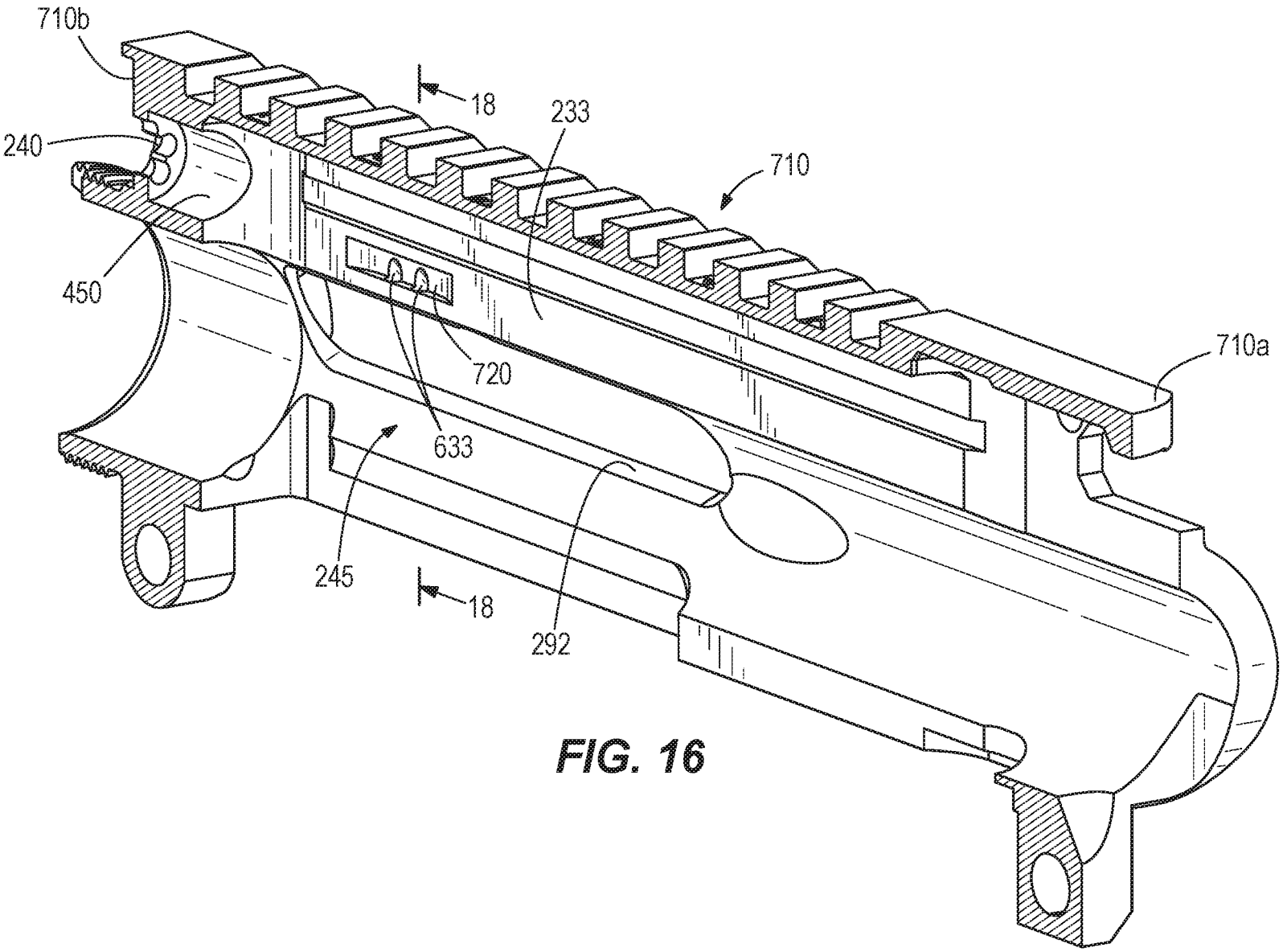
FIG. 16 is a cross-sectional view of the upper receiver taken along line 16-16 in FIG. 15.
Figure 17:
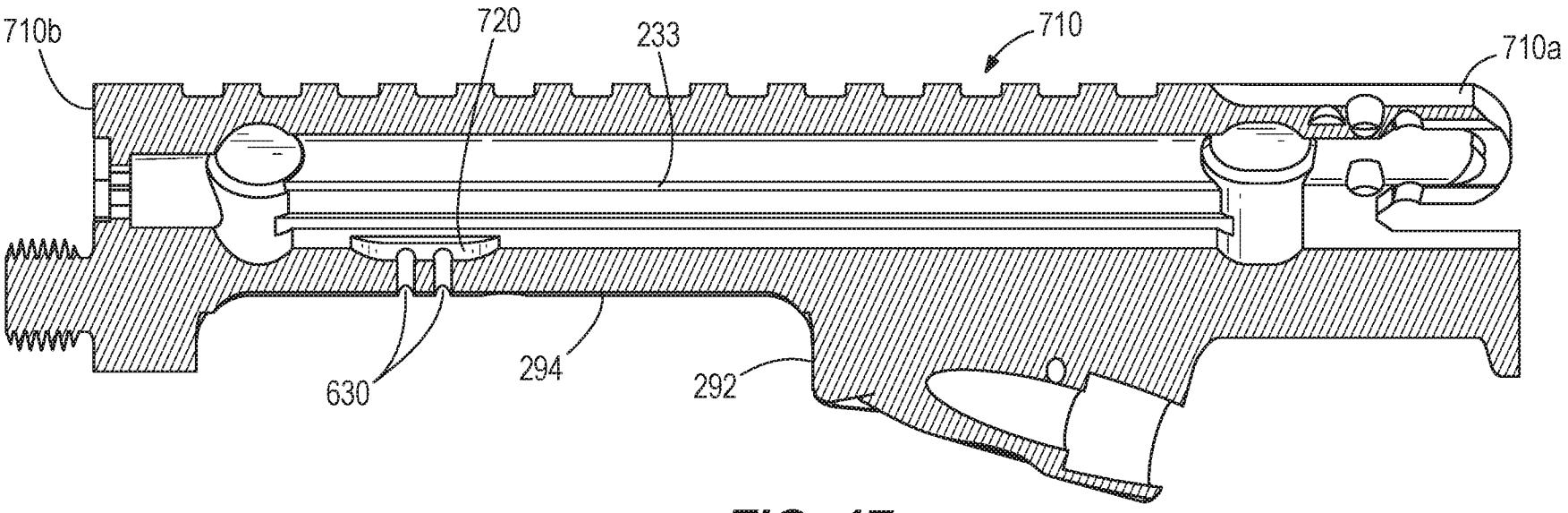
FIG. 17 is a cross-sectional view of the upper receiver taken along line 17-17 in FIG. 15.
Figure 18:
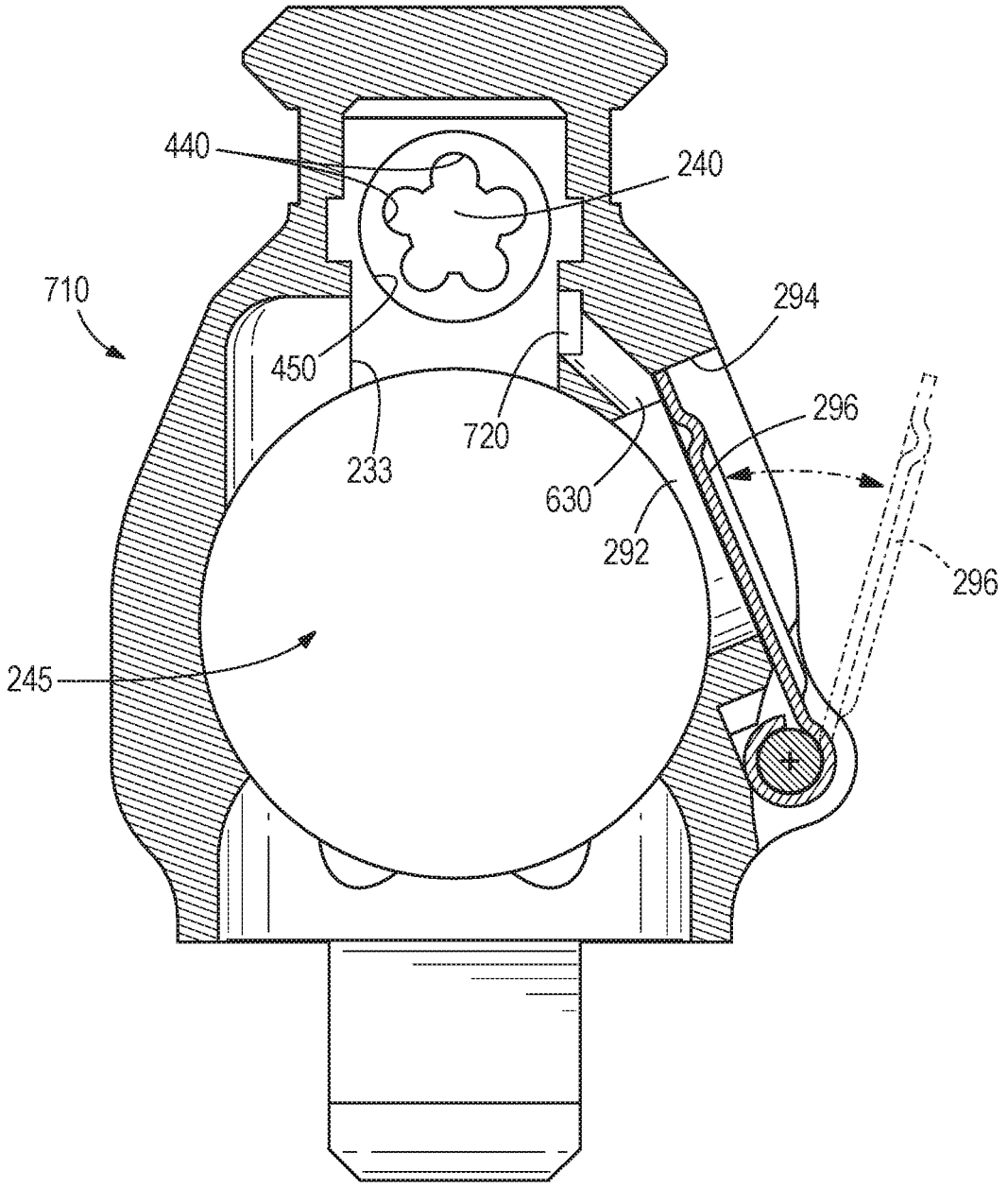
FIG. 18 is a cross-sectional view of the upper receiver taken along line 18-18 in FIG. 16.

FIGS. 12 and 13 illustrate an alternative construction of an upper receiver 610 which includes substantially all of the same features as the above-described upper receiver 510, except that the forward escape ports 530 are replaced with alternative forward escape ports 630. As with the forward escape ports 530, the alternative forward escape ports 630 communicate with the chamber 245 proximate the end of the gas tube 180. The alternative escape ports 630 angle down and extend through the shroud 294 around the ejection port 292. The alternative escape ports 630 are covered by the ejection port door 296 when the door 296 is in its normally-closed position such as when the firearm 100 is not being used, is being carried, or in between rounds being fired. The ejection port door 296 therefore covers the open ends of the alternative escape ports 630 to reduce the likelihood of dirt, mud, and foreign objects fully or partially occluding the alternative escape ports 630.

The escape ports 370, 520, 530, 630 are not limited to the positions, sizes, and cross-sectional shapes illustrated and can be provided in any combination of one, two, three, or all four of the sets of ports 370, 520, 530, 630 in other aspects of the invention.

FIGS. 14-18 illustrate an alternative construction of an upper receiver 710 which includes substantially all of the same features as the above-described upper receiver 610, such features being labeled with the same reference numbers used above. The upper receiver 710 includes a rear end 710*a* and a front end 710*b*. A trough 720 is formed in the inner wall of the upper receiver 710. In this construction of the upper receiver 710, the forward escape ports 630 communicate at their inner ends with the trough 720. The forward escape ports 630 extend down from the trough 720 through the frame or shroud 294 around the ejection port 292. In this regard, the trough 720 can be characterized as being formed on an inner surface of the frame or shroud 294.

The trough 720 faces and communicates with the charging handle channel 233. The charging handle channel 233 and the gas accumulation space 450 are considered part of the overall main chamber 245. Consequently, the trough 720 can also be said to communicate with the main chamber 245 (and any portion of it, including the charging handle channel 233 and the gas accumulation space 450). With reference to the arrows in FIG. 15 indicating the flow of barrel gases, the trough 720 collects barrel gasses for venting through the forward escape ports 630. The construction of FIGS. 14-18 includes two forward gas escape ports 630 but in other constructions there may be a single forward escape port 630 or more than two forward escape ports 630 of various sizes, cross-sectional shapes, and angles for the particular application.

As noted above, and as is illustrated in FIG. 18, the forward escape ports 630 are covered by the ejection port door 296 when the door 296 is in its normally-closed position such as when the firearm 100 is not being used, is being carried, or in between rounds being fired. The ejection port door 296 covers the open ends of the forward escape ports 630 to reduce the likelihood of dirt, mud, and foreign objects fully or partially occluding the alternative escape ports 630. After firing, gases in the chamber 245 apply a force (pressure multiplied by the surface area to which the pressure is exposed) to the door 296, which pivots the door 296 open, as illustrated in broken lines in FIG. 18.

Thus, the invention provides, among other things, an improved upper receiver which includes gas handling features for reducing gas pressure in the chamber, avoiding gas flow rearward, and reducing the weight of the upper receiver. Various features and advantages of the invention are set forth in the following claims.

What is claimed is:

1. An upper receiver for a firearm having a barrel extending forward of the upper receiver and a buttstock extending rearward of the upper receiver, the upper receiver comprising:

a chamber communicating with the barrel to receive high pressure barrel gases for actuating an action of the firearm;

an ejection port through which a spent round is ejected as part of the action of the firearm, the ejection port defined at least in part by a frame;

a charging handle channel extending a length of the upper receiver and accommodating a charging handle;

a trough formed into a surface of the upper receiver and communicating with the chamber, the trough facing and communicating with the charging handle channel; and a gas escape port extending through the frame and communicating with the trough such that barrel gases in the chamber are collected in the trough and vented through the gas escape port.

2. The upper receiver of claim 1, further comprising an ejection port door biased to cover the ejection port and opening under the influence of pressure from the barrel gases to open to permit ejection of the spent round.

3. The upper receiver of claim 1, the gas escape port includes a plurality of gas escape ports extending through the frame and communicating with the trough.

* * * * *